United States Patent [19]

Anahara et al.

[11] 4,010,601

[45] Mar. 8, 1977

[54] METHOD FOR MANUFACTURING A FANCY TEXTURED YARN PROVIDED WITH SLUBS

[75] Inventors: Meiji Anahara, Kyoto; Tsugio Take, Takatsuki; Yutaka Kajihara, Akashi, all of Japan

[73] Assignee: Toyo Boseki Kabushiki Kaisha, Osaka, Japan

[22] Filed: June 24, 1975

[21] Appl. No.: 589,919

[52] U.S. Cl. ..... 57/160; 57/157 TS

[51] Int. Cl.[2] ..... D02G 3/34; D02G 3/38

[58] Field of Search ..... 57/140 J, 144, 157 TS, 57/160, 140 BY

[56] References Cited

UNITED STATES PATENTS

| | | | |
|---|---|---|---|
| 2,731,789 | 1/1956 | Holder | 57/160 |
| 3,445,994 | 5/1969 | Nalpas | 57/160 X |
| 3,508,389 | 4/1970 | Chatin | 57/160 X |
| 3,685,268 | 8/1972 | Sequin | 57/160 X |
| 3,844,103 | 10/1974 | Sasaki et al. | 57/160 X |

FOREIGN PATENTS OR APPLICATIONS

| | | |
|---|---|---|
| 50,338 | 2/1973 | Japan |

*Primary Examiner*—Richard C. Queisser
*Assistant Examiner*—Charles Gorenstein
*Attorney, Agent, or Firm*—Burgess Ryan and Wayne

[57] ABSTRACT

A method for manufacturing a fancy textured yarn provided with slubs. In this manufacturing method, at least one thermoplastic multifilament yarn A is supplied to a twisting zone of a false twisting apparatus provided with a heater disposed at an upstream position to a false twisting element and at least one thermoplastic multifilament yarn B is supplied to the above-mentioned twisting zone so as to combine with the yarn A by way of a yarn guide which is reciprocally displaced along the yarn passage of the yarn A. The combined yarn is heat-set by the heater and then untwisted after passing through the false twisting element. Thereafter the untwisted yarn provided with numerous stable slubs composed of the yarn B, formed by wrapping the yarn B about the yarn A, is taken up to a yarn package. In the above-mentioned processing, the displacing speed of the yarn guide toward the false twisting element is controlled in a range between less than one time and at least 0.5 times the running speed of the yarn A.

12 Claims, 14 Drawing Figures

METHOD FOR MANUFACTURING A FANCY TEXTURED YARN PROVIDED WITH SLUBS

SUMMARY OF THE INVENTION

The present invention relates to a method for manufacturing a fancy textured yarn provided with slubs.

Various methods for manufacturing fancy textured yarns provided with slubs, which are distributed along the ground yarn thereof, have been well-known in the textile industry. For example, the Japanese Pat. No. 3922/1960 discloses such a method wherein a pair of material yarns are supplied to a false twisting device in such a condition that the feeding speed of one of the material yarns to a position upstream of the heater of the false-twisting device is intermittently increased. However, it was confirmed that, the size of slubs formed along the ground yarn is not distinguished and the wrapping condition of these slubs on the ground portion of this fancy textured yarn is not stable. Further, the appearance of this fancy textured yarn is rather similar to a poor quality yarn having an irregular variation of thickness. It is also well known that the Japanese Pat. No. 28258/1968 discloses a manufacturing method, wherein a plurality of material yarns are fed to a false-twisting device in such a condition that the supply speeds or yarn tentions of these material yarns are relatively changed at the feeding points thereof via a yarn guide where the twisting of the material yarns is commenced. The position of this yarn guide is displaced during the operation so as to intermittently change the number of twists imported to the material yarns. However, when the number of twists is changed by displacing the yarn guide, the direction of twists imparted to the yarn is alternately changed and the size of slubs produced is not very large. Consequently, it is impossible to create a desirable fancy effect by these slubs.

Beside the above-mentioned methods for manufacturing the fancy textured yarns, it is also known that a material yarn for creating a fancy component is combined with a ground yarn at a position upstream of a false-twisting spindle in an over feed condition of more than 10%, compared with the supply speed of the ground yarn to the false twisting device, or; the tension of the above-mentioned material yarn is intermittently changed when the material yarn and the ground yarn are fed to the false-twisting spindle in a combined condition so as to produce a twisted yarn wherein these supplied yarns are alternately wrapped around other; thereafter, the twisted yarn is intermittently abraded in a stretch condition so that slubs are created along the twisted yarn (Japanese Pat. No. 16895/1970). The Japanese Pat. No. 50338/1972 discloses a method for manufacturing fancy textured yarn, wherein a plurality of material yarns are supplied to a spindle of a false twisting device in such a condition that one of the material yarns is combined with the other material yarns at a position upstream of the spindle and this position is continuously or intermittently displaced. The false twisted yarn is abraded by a special separating guide at a position downstream of the untwisting zone of the false twisting device so as to create slubs along the ground yarn. However, the slubs created by the above-mentioned two manufacturing methods are not stably fixed to the ground yarn, and are loosely held by the ground yarn. Consequently, such slubs are easily stroked along the ground yarn. Since the fancy textured yarn thus produced must normally be rewound, the slubs of the fancy textured yarn are stroked along the ground yan or the shape thereof tends to be deformed when the slubs pass through the yarn guides of the rewinding machine. Consequently, such unstable slubs tend to injure the appearance of the final product utilizing such fancy textured yarns.

The principle object of the present invention is to provide a unique method for manufacturing fancy textured yarn by utilizing a false twisting device whereby the above-mentioned drawbacks of the well known methods can be perfectly eliminated, that is, to provide a method for manufacturing fancy textured yarn provided with stable slubs having such shape that a thicker portion is formed in the central portion of each slub and a pair of longitudinal end portions are gradually decreasing their thickness.

To attain the purpose of the present invention, in the method for manufacturing fancy textured yarn a plurality of material yarns are supplied to a false twisting device and at least one of the material yarns is wrapped about the material yarn for forming the core portion thereof at the false twisting zone of the false-twisting device. The above-mentioned material yarn for forming the core portion is hereinafter referred to as a first material yarn while the material yarn for wrapping the first yarn is hereinafter referred to as a second material yarn. When the second material yarn is wrapped about the first material yarn at the false-twisting zone of the false twisting device, the second material yarn is combined with the first material yarn which is being carried to the twist imparting member of the false twisting device via a yarn guide. The yarn guide is reciprocally moving along the passage of the first material yarn in such a condition that the speed of the forward motion of the yarn guide toward the twist imparting member is less than one time and at least 0.5 time the running speed of the first material yarn. To assure the above-mentioned relative motion of the first and second material yarns, in the method for manufacturing fancy textured yarn according to the present invention, the carrying speed of the yarn guide and the period, stroke, of the reciprocal motion of the yarn guide are controlled to a predetermined condition, respectively. The conventional false twisting machine provided with a pin type false-twisting spindle, and at least one heater which is disposed at the twisting zone thereof for carrying out heat-set of the twisted yarn, can be effectively utilized for the present invention.

Thermoplastic synthetic yarns such as the multifilament yarn of polyester, polyamide, polypropilene, acrylnitril, or mixed filament yarn containing the above-mentioned thermoplastic synthetic filament, are preferably utilized for manufacturing fancy textured yarn according to the present invention.

To effectively carrying out the present invention, it is very important to chose a suitable traversing yarn guide for the second material yarn B and a mechanism for actuating the motion of this yarn guide. Concerning the mechanism for traversing the yarn guide, various mechanisms such as a reciprocal motion mechanism utilizing a piston mechanism, a crank or cam mechanism can be satisfactorily applied. The detailed explanation thereof is described in the latter part of this specification.

DETAILED EXPLANATION OF THE INVENTION

Figure 1:
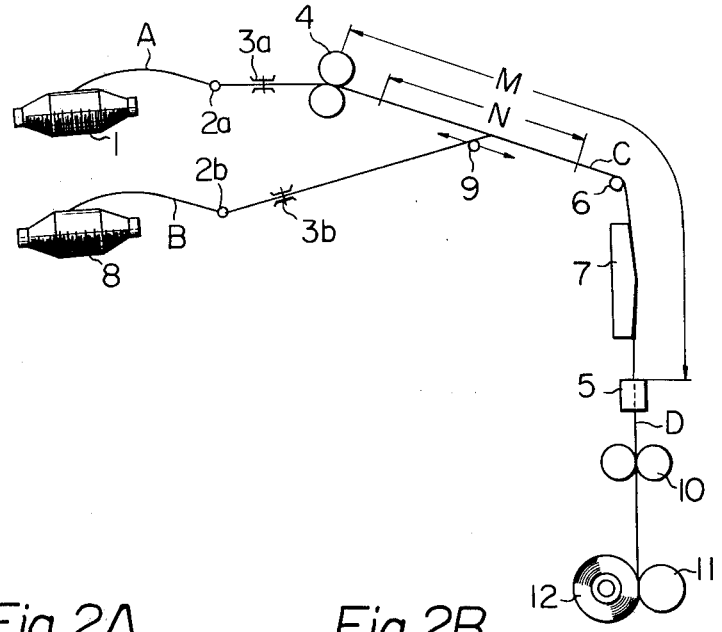
FIG. 1 is a schematic side view of the apparatus for carrying out the method for manufacturing a fancy textured yarn according to the present invention.

The method for manufacturing the fancy textured yarn according to the present invention is hereinafter explained in detail with reference to FIG. 1.

A first material yarn A, which forms a core yarn of a fancy textured yarn D, is supplied from a pirn 1 to a twisting zone M of a false twisting device via a snail wire 2*a*, a tension regulating device 3*a* which comprises a pair of washers biased against each other, and a pair of feed rollers 4. The twisting zone M is formed at a yarn passage between a nip point of the feed rollers 4 and a false twisting element 5 such as a false twisting spindle. The first yarn A is carried to a heater 7 via a guide roller 6 and the twists imparted to the first yarn A are heat-set by the heater 7 and, thereafter, the yarn is carried to the false twisting element 5. A second yarn B is supplied from another pirn 8 to a traverse yarn guide 9 which is reciprocally traversing along the yarn passage of the first yarn A at a wrapping zone N formed at a position between the feed rollers 4 and the guide roller 6, via a snail wire 2*a*, a yarn tension regulating device 3*b*, which is similar to the yarn tension regulating device 3*a*, so as to wrap the second yarn B about the first yarn A. Since the first yarn A is twisted about the longitudinal axis thereof in the twisting zone M according to the twisting action of the false twisting element 5, while the second yarn B meets the first yarn A in such a condition that the position where the second yarn B meets the first yarn A is reciprocally moved along the wrapping zone N, the second yarn B is intermittently wrapped about the first yarn A at portions of the first yarn A in a multiple wrapping condition. Therefore, thicker portions of the fancy textured yarn D, which are similar to slubs, are periodically formed. The thicker portion is hereinafter referred to as a "slub." These slubs and the ground portions are heat-set by the heater 7 when the combined yarn C, composed of the first yarn A and the second yarn B, is passed over the heater 7. After being heat-set, the combined yarn C passes through the false twisting element 5 and the twists imparted to the first yarn A are untwisted together with the second yarn B. However, the relative twists of the yarn B to the yarn A imparted at the portion of each slub are substantially maintained after passing through the false twisting spindle 5, consequently, the shape of slubs can be stably maintained on the core yarn, that is, the first yarn A. The thus produced fancy textured yarn D is taken up by a pair of delivery rollers 10 and a yarn package 12 is formed by a take-up roller 11 from the yarn D delivered from the delivery roller 10.

Figure 2A:
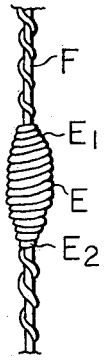
FIG. 2A is a schematic side view of a slub portion of the fancy textured yarn produced by the apparatus shown in FIG. 1.

Each slub E of the fancy textured yarn D has a central thicker portion $E_1$ and a pair of end portions $E_2$ where the thickness thereof is gradually reduced toward the end thereof as shown in FIG. 2A. The length of these slubs can be changed by changing the stroke and speed of the reciprocal motion of the yarn guide 9. According to our tests, it is understood that the slub E shown in FIG. 2A is the preferable condition for the end use of the fancy textured yarn. That is, the thickness $E_1$ is 1.3 – 4 times the thickness of the core yarn A and the slub forms a spindle shape as shown in FIG. 2A. In each slub, the second yarn B wraps about the first yarn or core yarn A in a multiple layered condition. Since the combined yarn C is heat-set by the heater 7, the slub E is fixed so that the slubs E maintain their construction even after the yarn D is untwisted in the untwisting zone of the false twisting device. According to our experience, the above-mentioned preferable shaped slubs are effectively created if the thickness of the first yarn A is similar to that of the second yarn B. If the thickness of these material yarns A and B are unbalanced, the above-mentioned fancy effect of the slub will be reduced. To produce the above-mentioned slub E shown in FIG. 2A, it is necessary to control the reciprocal motion of the yarn guide 9 in such a way that the displacing speed $V_1$ of the yarn guide 9 toward the guide roller 6 is in a range between 0.5 times the carrying speed $V_0$ of the first yarn A toward the guide roller 6 at a position of the wrapping zone N and less than the speed $V_0$, preferably at a speed more than 0.7 times $V_0$ but less than $V_0$.

Generally speaking, when a material yarn runs in the twisting zone of the false twisting device, the material yarn is gradually contracted because of the creation of twist contraction. Consequently, the running speed of the material yarn in the twisting zone is reduced in comparison with the feed speed of the material yarn into the twisting zone. The above-mentioned twist contraction varies according to number of twists imparted to the material yarn, thickness and filamental construction of the material yarn, yarn tension, etc. However, the above-mentioned twist shrinkage is also changed by the twist-distribution along the yarn, disposition of the heater for heat setting the twisted yarn, possible bending of the yarn during the running of the yarn, etc. Consequently, the running speed of the material yarn A in the twisting zone M or the wrapping zone N should be selected based on consideration of the above-mentioned factors.

Figure 2B:
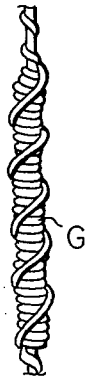
FIG. 2B is a schematic side view of an undesirable slub portion of the fancy textured yarn produced by the apparatus shown in FIG. 1, in an uncontrolled condition.

If the displacing speed of the yarn guide 9 toward the guide roller 6 is selected so that the running speed of the first yarn A in the wrapping zone N is slower than the above-mentioned displacing speed of the yarn guide 9, the second yarn B wraps about the first yarn A in a triple layered condition and, consequently, it is impossible to produce the spindle shaped slubs E shown in FIG. 2A. Further, in the above-mentioned undesirable condition, if the reverse motion of the yarn guide 9 toward the feed rollers 4 at the forward terminal of the reciprocal motion of the yarn guide 9 is carried out at very slow speed, which condition may be created in such a case where a crank mechanism is utilized, the second yarn B wraps around the first yarn A in a multiple layered condition at both sides of each thicker portion. As a result, a slub G having undesirable configuration as shown in FIG. 2B is frequently produced. According to our experience, the above-mentioned configuration of the slub G should be eliminated from the fancy textured yarn produced by the method according to the present invention, because this type of slub G is loose and is very easy to move along the first yarn (core yarn) A by stroking.

In such a case where the displacing speed $V_1$ of the yarn guide 9 toward the guide roller 6 is slower than a speed which is 0.5 times the running speed of the first yarn A, the wrapping density of the second yarn B about the first yarn A becomes insufficient. Consequently, even though two material yarns having different dyeability are combined, the fancy effect created by the slubs is not distinguished, in spite of the color effect created by the above-mentioned combination, as shown in the example hereinafter described.

According to our experiments, it was confirmed that there is no restriction concerning the speed of the return motion of the yarn guide 9 towards the feed rollers 4. However, since the ground portions F (see FIG. 2A) of the fancy textured yarn D are formed at a time composed of a period defined by the above-mentioned return motion of the yarn guide 9 and a period of stopping the yarn guide 9 at its standby position corresponding to a terminal of the above-mentioned return motion, it is desirable to displace the yarn guide 9 toward the feed rollers 4 at uniform rate of displacement which is slower than the above-mentioned displacing speed $V_1$ of the yarn guide 9.

In the above-mentioned method for manufacturing the fancy textured yarn according to the present invention, it is necessary to maintain the surface temperature of the heater 7 at a condition which is sufficient to carry out the heat-set operation of the combined yarn C. That is, since the wrapping density of the second yarn B about the first yarn A is possibly very small when the yarn guide 9 is instantly stopped at both ends of the reciprocal motion thereof or the displacing speed $V_1$ of the yarn guide 9 is at the lower limit of the above-mentioned allowable range, it is necessary to fix the wrapping condition of the second yarn B about the first yarn A so as to produce stable slubs on the textured yarn D.

Figure 3:
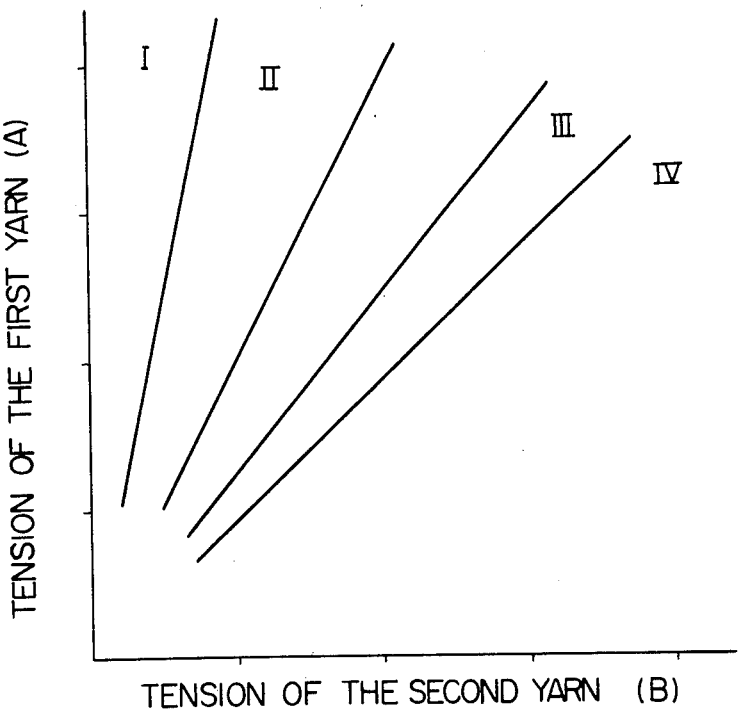
FIG. 3 is diagrams representing the fancy effect of the textured yarn produced by the method of the present invention showing the relationships of the tension of the first yarn (core yarn) A to the tension of the second yarn B.

It was found that the relation between the tension of the first yarn A and that of the second yarn B in the wrapping zone N is also one of the important factors related to the quality of the fancy textured yarn as shown in FIG. 3. Therefore, several confirming tests were carried out and it was found that, since the slub E is formed by wrapping the second yarn B about the first yarn A, if the above-mentioned tension of the yarn B is much smaller than the tension of the first yarn A the thickness of the slub becomes larger, for example the tension of the yarn B is less than 0.1 times that of the yarn A, however, the yarn B is roughly wrapped about the first yarn A. Consequently, the configuration of the slub E is formed in a loose condition so that this portion can be easily stroked (Condition 1 in FIG. 3). Contrary to this, if the above-mentioned tension of the second yarn B is very large in comparison with the tension of the first yarn A, for example the tension of the yarn B is larger than that of the yarn A, the second yarn B is tightly wrapped about the first yarn A and the thickness of the thicker portion E becomes small so that the fancy effect is remarkably reduced (Condition IV in FIG. 3).

Repeated experimental tests were carried out to find a desirable yarn tension for producing the effective fancy thicker portions of the fancy textured yarn, and it was concluded that the most pertinent condition of the tension of the second yarn B should be maintained in a range between 0.1 times of the running tension of the first yarn A and that of the first yarn A in the wrapping zone N (condition II in FIG. 3). Since the second yarn B is heat-set under smaller yarn tension in comparison with the first yarn A, if the fancy textured yarn is dyed and an identical material yarn is utilized for the first and second yarns A, B, the second yarn B is dyed in a darker color in comparison with the first yarn A and, therefore, the ground portion of the fancy textured yarn tends be dyed in a striped condition. If, it is desirable to eliminate the above-mentioned striped dyeing effect, the tension of the second yarn B must be maintained in a range between more than 0.8 times the running tension of the first yarn A and that of the first yarn A in the wrapping zone N. However, it must be realized that, if the tension of the second yarn B is maintained as mentioned above to eliminate the above-mentioned striped dyeing effect, since the tension of the second yarn B is fairly large in comparison with the condition creating the striped dyeing effect, the thickness of the slub E becomes more compact in comparison with the above-mentioned condition, but the fancy effect can be sufficiently maintained in a fabric produced from this fancy textured yarn (Condition III in FIG. 3).

EXAMPLE 1

The apparatus shown in FIG. 1 is utilized for manufacturing the fancy textured yarn. A normal polyester multifilament yarn 150 D/48*f* and a dyeable polyester multifilament yarn 150 D/48*f*, which is dyeable by an acid dyestuff, are utilized as first and second material yarns respectively. A conventional false twisting device is utilized to produce the fancy textured yarn. This false twisting device is operated so as to maintain the following conditions: the rotation speed of a false twisting spindle is 131,000/min, the number of twist imparted to the first yarn A is 1885 turns per meter, the temperature of the heater is 180° C, and the first yarn A is supplied to the twisting zone in a condition of 4% over feed. The operating condition of the traverse mechanism of the yarn guide 9 are as follows: the stroke of the reciprocal motion of the yarn guide 9 is 45 cm, the supply speed of the first yarn A to the wrapping zone N is 72 m/min, the displacing speed $V_1$ of the return motion of the yarn guide 9 is 5.2 m/min, and the running speed $V_0$ of the first yarn A is 66.6 m/min in the wrapping zone N, while the displacing speed $V_1$ of the yarn guide 9 toward the guide roller 6 is selected according to the various condition as shown in Table 1. The number of twists (*n*) imparted to the first yarn A and the twist shrinkage (S) in the wrapping zone N were measured. The number of twists (*n*) was 1171 T/meter, while the twist shrinkage (S) was 7.6%. The displacing speed $V_1$ of the yarn guide 9 toward the guide roller 6 in the wrapping zone N was measured by means of a pair of non contacting switches disposed at two positions adjacent to the displacing passage of a bracket holding the yarn guide 9 in such a way that these switches detect the time for displacing an iron piece mounted on the bracket between two positions adjacent to the above-mentioned non contacting switches. The fancy textured yarns thus produced were utilized as weft yarns for producing a fabric of ⅓ broken twill, while a regular polyester multifilament yarn 50 D/24*f* was utilized as a warp yarn. The density of warp and weft yarns were 110/inch and 65/inch respectively. The width of the fabric thus produced was 43 inch. The above-mentioned fabric was dyed in a dyeing bath containing a mixture of a disperse dyestuff (Forom Brilliant Yellow SE6GFL produced by Sandoz, 1% solution) with an acid dyestuff (Suminol Fast REd BB produced by Sumitomo Chemical Ind., 2% solution) in a pH condition of 2.5, at 135° C, for 45 min. The first yarn A was colored yellow while the second yarn B was colored red. Therefore the fabric was dyed in a fine pitch striped condition colored by orange and yellow and the fancy thicker portions of red color were distributed in the above-mentioned colored fabric. The fancy effects created in the sample fabrics thus produced were observed so as to find the effect of the fancy slubs produced by the method according to the present invention. As clearly shown in the following Table 1, the preferable condition of the displacing speed $V_1$ of the yarn guide 9 was confirmed as in the condition already mentioned.

Table I

| The running speed of the first yarn A in the wrapping zone N; in m/min ($V_0$) | The displacing speed of the yarn guide 9 in the zone N; in m/min ($V_1$) | Ratio $V_1/V_0$ | Fancy effect of the slubs D | Color effect to the ground portion of the fancy textured yarn |
|---|---|---|---|---|
| 66.6 | 9.0 | 0.14 | poor | poor |
| 66.6 | 15.0 | 0.23 | poor | poor |
| 66.6 | 26.0 | 0.39 | poor | better |
| 66.6 | 35.3 | 0.53 | better | good |
| 66.6 | 45.0 | 0.68 | good | excellent |
| 66.6 | 51.4 | 0.77 | excellent | excellent |
| 66.6 | 55.4 | 0.83 | excellent | very excellent |
| 66.6 | 60.0 | 0.90 | very excellent | very excellent |
| 66.6 | 64.2 | 0.96 | very excellent | very excellent |
| 66.6 | 75.0 | 1.13 | poor | excellent |

As shown in Table 1, if the displacing speed $V_1$ of the yarn guide 9 was controlled so as to be within a range between the running speed of the first yarn A and 0.7 times the same, effective fancy slubs having a spindle shape were produced and the fancy effect of this fancy textured yarn was excellent or very excellent. In these conditions, since the second yarn B is stably wrapped about the first yarn A at the portion of each slub and the configuration of these wrapped portions of the second yarn B about the first yarn A were heat-set, the shape of these slubs could be stably maintained in the fabric. It was confirmed that, if the ratio $V_1/V_0$ was less than 0.39, it was difficult to produce useful slubs for creating the fancy effect, and; on the other hand, if the raio $V_1/V_0$ was larger than 1, even though the distinguished slubs could be produced by the second yarn B, the shape of these slubs was similar to a block, which was not suitable to produce a fancy fabric. Further, it was confirmed that, if the yarn guide 9 was displaced toward the guide roller 6 at a speed a little faster than the running speed of the first yarn A, the processing yarn was frequently broken, and, therefore, such condition can not used in practical mill operations.

The shape, size and distribution of the slubs can be changed by changing the operational combinations of the displacing speed $V_1$ of the yarn guide 9, as well as the stroke and period of the reciprocal motion of the yarn guide 9, so as to produce a fancy textured yarn having distinguished fancy effect.

Figure 4:
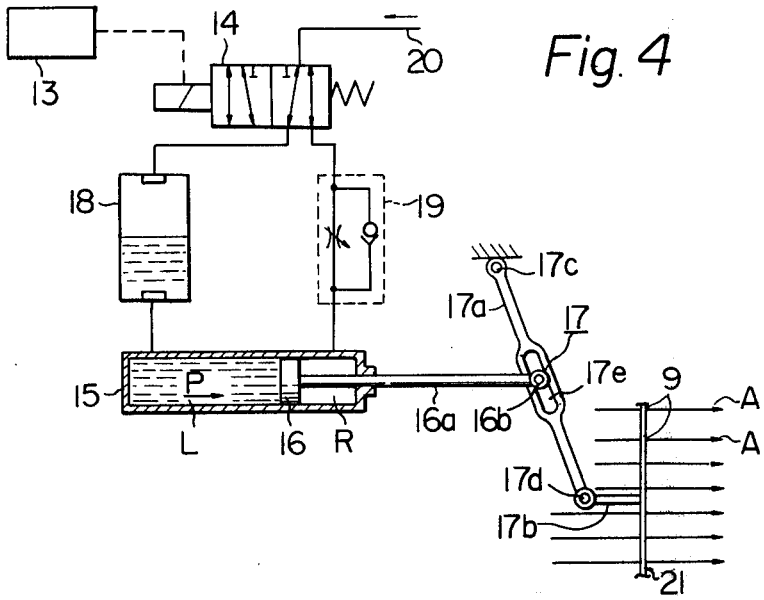
FIG. 4 is a diagrammatic view of the reciprocal motion mechanism of the yarn guide utilized for introducing the second yarn B the first yarn A, for combining the two yarns in the apparatus shown in FIG. 1.

The following mechanism shown in FIG. 4 can be utilized for producing the above-mentioned fancy textured yarn, according to the present invention.

In the device shown in FIG. 4, an actuator 13 is electrically connected to a magnet valve 14. A cylinder 15, provided with a piston 16, is connected to the magnet valve 14 via an air-hydro-convertor 18 and a speed controller 19 as hereinafter explained in detail. A link mechanism 17 connects the piston 16 to the yarn guide 9. The actuator 13 issues a predetermined signal so as to actuate the magnet valve 14. That is, the actuator 13 is a device comprising a program reader which issues electrical signals corresponding to a predetermined program, and the magnet valve 14 is actuated by the signals issued from the actuator 13. The above-mentioned program is made so as to record the length, thickness and periodic distribution of the slubs of the expected fancy textured yarn. The magnet valve 14 connects or disconnects the connection between a supply source 20 of compressed air and the air-hydro-convertor 18 which converts pneumatic pressure to oil pressure, or the connection between the supply source 20 of compressed air and the speed controller 19. The speed controller 19 works to restrict the air flow when air is introduced therein toward a direction for supply and works to maintain the air flow in a free condition when air is introduced therein toward a direction for discharge, alternately. Compressed oil is introduced into a chamber L of the cylinder 15, via the air-hydro-convertor 18, and compressed air is introduced into a chamber R of the cylinder 15, via the speed controller 19, in alternate condition. When the compressed oil is introduced into the chamber L, the piston 16 is displaced toward a direction represented by P in FIG. 4, when the compressed air is introduced into the chamber R, the piston 16 is displaced toward the direction opposite the direction P. The link mechanism 17 comprises a first rod 17*a* which is swingably supported by a stationary pin shaft 17*c* and a second rod 17*b* which is pivotally connected to a free end of the first rod 17*a* by a pivot 17*d*. The first rod 17*a* is provided with a slot 17*e* formed at a middle portion thereof and the first rod 17*a* is slidably connected to a free end of a piston rod 16*a* of the cylinder 15 by a connecting pin 16*b*. The second rod 17*b* is connected to a guide bar 21 provided with a plurality of yarn guides 9, each of which guide a corresponding second yarn B. The displacing speed of the yarn guides 9 depends upon the relative condition of the pressure of the compressed oil and compressed air, and the amplification of the link mechanism 17.

When the magnet valve 14 is maintained in the condition shown in FIG. 4, the compressed air is introduced from the supply source 20 into the air-hydro-convertor 18 and the oil contained in the air-hydro-convertor 18 is compressed so that the compressed oil is introduced into the chamber L of the cylinder 15 and, consequently, the piston 16 is displaced toward the direction P. According to the above-mentioned motion of the piston 16, the yarn guides 9 are displaced toward the running direction of the first yarns A, respectively, by way of the motion of the link mechanism. During the above-mentioned motion of the piston 16, the compressed air in the chamber R of the cylinder 15 is discharged into the atmosphere by way of the speed controller 19 and the magnet valve 14.

It is required that the fluid utilized for the chamber L of the cylinder 15 be a non-compressible fluid. Since the running speed of the first yarn A in the wrapping zone N is in a range between 50 and 150 m/min, and the yarn guide 9 is displaced to follow the running of the first yarn A, it is essential to complete the supply motion of the compressed fluid into the chamber L of the cylinder 15 within less than 1 second normally. The above-mentioned time condition varies due to the stroke of the reciprocal motion of the yarn guide 9. Consequently, if a compressible fluid is utilized for the chamber L, a large shock, due to the reaction of the elements for discharging, is imparted to the piston 16 when one reciprocal motion of the yarn guide 9 is completed and, therefore, the yarn guide 9 is instantly displaced backwards from a forward terminal position of the displacement toward the guide roller 6. According to the above-mentioned trouble, the wrapping condition of the second yarn B about the first yarn A is injured and some yarn defects may be created or the processing yarn may break down.

On the other hand, if a non-compressible fluid is utilized for the air-hydro-convertor 18 and the chamber L of the cylinder 15, the displacing speed of the piston 16 can not be over a certain limit. To compensate for this restriction, the link mechanism 17 normally amplifies the motion of the piston 16.

When the connecting condition of the magnet valve 14 is changed by the signal issued from the actuator 13, the compressed air from the supply source 20 is introduced into the chamber R of the cylinder 15 via the speed controller 19 which restricts the free flow of the compressed air passing therethrough. Consequently, the piston 16 is displaced in a direction opposite the direction P so that the yarn guides 9 is displaced toward a direction opposite the running direction of the first yarn A. During the above-mentioned operation, the oil in the chamber L of the cylinder 15 is returned back into the air-hydro-convertor 18, and air in the air-hydro-convertor 18 is discharged into the atmosphere via the magnet valve 14. Since the air flow toward the chamber R of the cylinder 15 through the speed controller 19 is restricted by the action of the speed controller 19, the displacing speed of the piston 16 can be effectively controlled by the condition of the above-mentioned restriction. Therefore, it is very easy to control the speed of the return motion of the yarn guide 9 so that it is slower than the displacing speed of the yarn guide 9 toward the guide roller 6. The period of the reciprocal motion of the yarn guide 9 can be easily controlled by the predetermined program set in the actuator 13 for actuating the magnet valve 14. The above-mentioned control of the period of the reciprocal motion of the yarn guide 9 is carried out by selecting a time for stopping the yarn guide at its standby position which corresponds to a terminal of the return motion of the yarn guide 9 corresponding to the upstream end of wrapping zone N.

Figure 5:
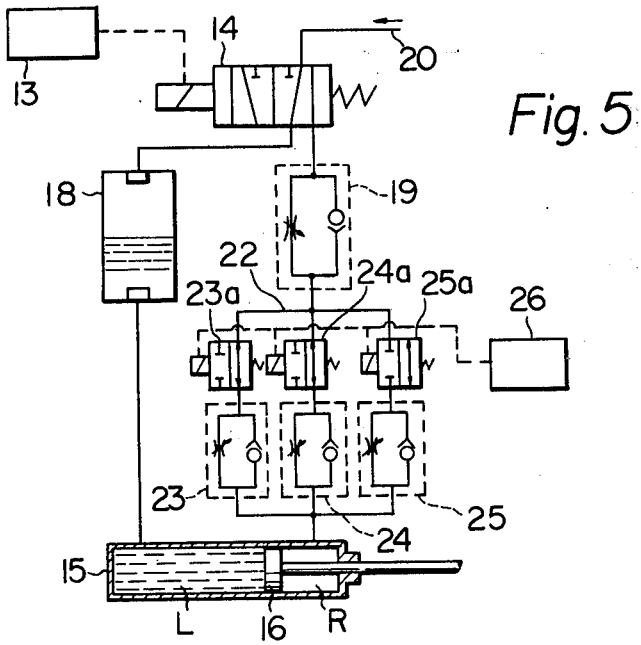
FIG. 5 is a diagrammatic view of the modification of the reciprocal motion mechanism shown in FIG. 4.

In the device shown in FIG. 5, which is a modification of the device shown in FIG. 4, a plurality of speed controllers 23, 24 and 25 are arranged between the speed controller 19 and the chamber R of the cylinder 15 by way of a connecting conduit 22. Each one of these speed controllers 23, 24 and 25 has such a function that, when air flow is directed toward the chamber R, the air flow is not restricted, but the air flow is restricted when the air flow is directed in the discharging direction toward the speed controller 19. These speed controllers 23, 24 and 25 are connected to magnet valves 23*a*, 24*a* and 25*a*, respectively. These magnet valves 23*a*, 24*a* and 25*a* are actuated by an actuator 26 which issues signals, due to a recorded predetermined program therein, in such a way that the quantity of air discharging from the chamber R of the cylinder 15 is adjusted by the action of the speed controllers 23, 24 and 25 in separate or combined condition. Consequently, when the piston 16 is displaced toward the outward direction (left in FIG. 5), the discharging air flow from the chamber R can be variously restricted by the action of the speed controllers 23, 24 and 25 and, even though the oil pressure applied to the chamber L of the piston 16 is constant, the displacing speed of the piston 16 toward the outside of the cylinder 15 (left in FIG. 5) can be changed to several different conditions. The number of the speed controllers arranged in the connecting conduit 22 may be changed. The variety of the displacing speed $V_1$ of the yarn guide 9 can be increased in arithmetical progression by increasing the number of the speed controllers. According to our experience, the above-mentioned air-hydroconvertor may be utilized for the chamber R in addition to the above-mentioned speed controller. In this condition, a noncompressive fluid can be utilized for the chamber R of the cylinder 15.

Figure 6:
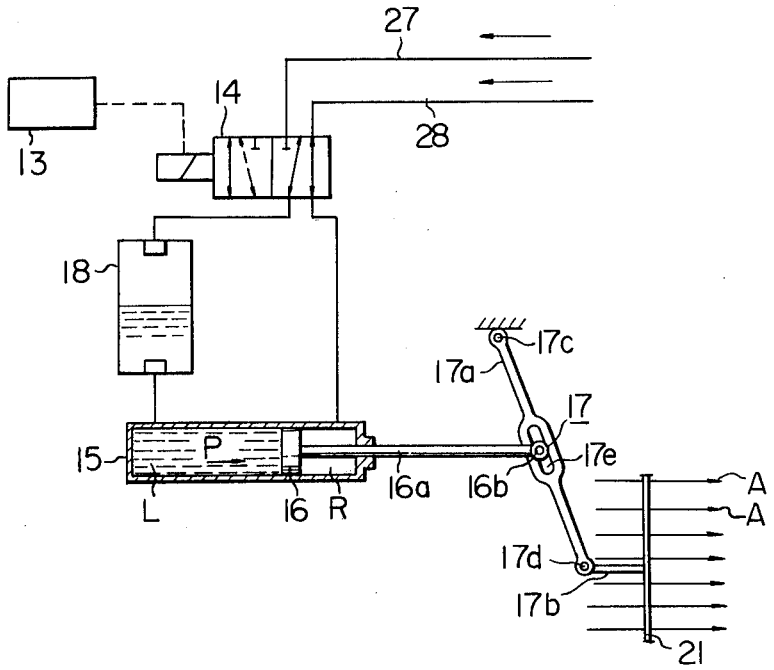
FIG. 6 is a diagrammatic view of another modification of the reciprocal motion mechanism shown in FIG. 4.

In the above-mentioned embodiments shown in FIGS. 4 and 5, a single compressive fluid is utilized for actuating the air-hydro-convertor 18 and for supplying the compressed air into the chamber R of the cylinder 15. However, it is also useful to utilize two different sources of compressed air in such a way that one of them is utilized to actuate the air-hydro-convertor 18, while the other one is supplied into the chamber R of the cylinder 15, as shown in FIG. 6. In this embodiment, the displacing speed $V_1$ of the yarn guide 9 toward the guide roller 6 and the return speed $V_2$ of the yarn guide toward the standby position at the upstream terminal of the wrapping zone N can be independently decided by changing the air pressure of the respective supply sources 27 and 28.

Figure 8:
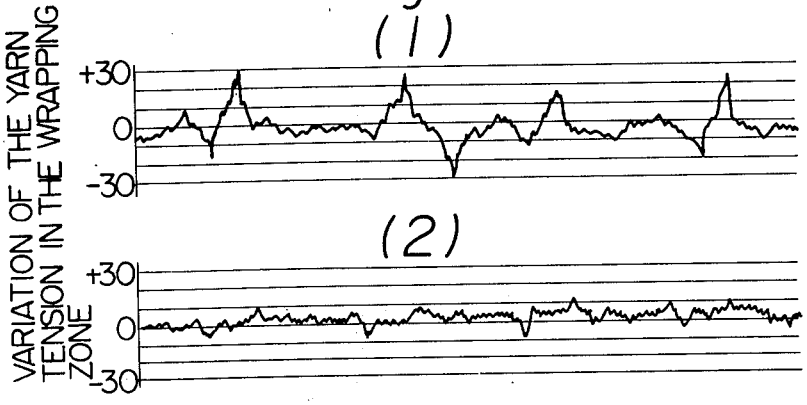
FIG. 8 is a drawing representing two diagrams showing the variation of yarn tension at a position along heater of the apparatus shown in FIG. 1 and FIG. 7.
Figure 7:
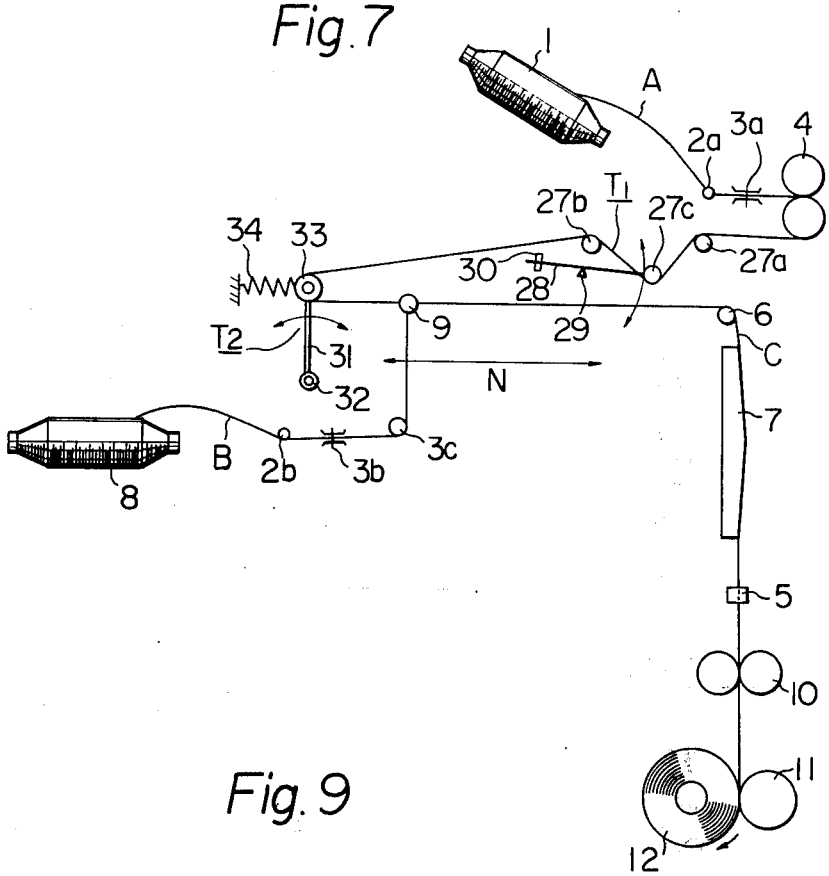
FIG. 7 is a schematic side view of a modification of the apparatus shown in FIG. 1.

According to our experimental tests, the tension of the combined yarn C varies according to the reciprocal motion of the yarn guide 9 when the combined yarn C passes over the heater 7. Therefore, the condition of the heat-set operation is changed so that the dyeability of the fancy textured yarn D varies along the lengthwise direction thereof. To eliminate this variation of the dyeability of the fancy textured yarn, it is useful to utilize a mechanism for absorbing the excess yarn tension created due to the reciprocal motion of the yarn guide 9. In the excess tension absorbing mechanism shown in FIG. 7, the first yarn A is supplied from the pirn 1 to the feed rollers 4 via the snail wire 2*a* and the tension control device 3*a*, and then the first yarn A is supplied into the wrapping zone N by way of a first tension control device $T_1$ and a second tension control device $T_2$. The tension control device $T_1$ comprises a pair of guide rollers 27*a* and 27*b* rotatably disposed at respective stationary positions along the yarn passage of the first yarn A and a balance roller 27*c* displaceably positioned between these rollers 27*a* and 27*b*. The balance roller 27*c* is rotatably mounted on a balance lever 28 which is turnably supported by a fulcrum 29. A balance weight 30 is mounted on a free end portion of the lever 28. Therefore, when the first yarn A passes through the guide rollers 27*a*, 27*b* and the balance roller 27*c*, if the tension of the first yarn A is lowered, the balance lever 28 turns clockwise so that the tension of the yarn A can be maintained in a uniform condition. The second tension control device $T_2$ comprises a tension lever 31, which is turnably supported by a pivot shaft 32, a guide roller 33 turnably mounted on the tension lever 31 and a tension spring 34 which always imparts a pulling force to the tension lever 31 so as to turn the lever 31 in a counter-clockwise direction. In this embodiment the first yarn A is introduced into the wrapping zone N after passing over the guide roller 33. Therefore, if the tension of the first yarn A is lowered, the tension lever 31 turns toward the counter-clockwise direction in FIG. 7 so that the slackened condition of the first yarn A can be easily compensated. Concerning the second yarn B, a mechanism, for supplying the yarn B into the wrapping zone N, which is similar to the embodiment shown in FIG. 1 is utilized. In this embodiment, 3*c* designates an additional guide roller disposed between the tension control device 3*b* and the yarn guide 9. In the above-mentioned embodiment, two tension control devices $T_1$ and $T_2$ are utilized to eliminate the possible variation of the combined yarn C, however, it is sufficient to apply one either one of the above-mentioned two devices $T_1$, $T_2$, for the above-mentioned purpose. The effect created by the tension control devices $T_1$ and $T_2$ can be understood from the tension diagrams I and II shown in FIG. 8, wherein the diagram I represents the condition without utilizing the tension control device ($T_1$, $T_2$), while the diagram II represents the condition attained by the embodiment shown in FIG. 7.

Several mechanisms for providing the reciprocal motion of the yarn guide 9 are explained hereinafter.

A. The conventional crank mechanism is available to provide the reciprocal motion of the yarn guide 9. That is, referring to FIG. 9, the thread guide 9 is fixed to a free end of a rod 37 connected to a sliding member 36 which is slidably disposed in a guide member 35. The sliding member 36 is pivotally connected to a connecting rod 38, one end of which is also pivotally connected to an end of a crank arm 39 which is rotating toward a direction represented by an arrow in FIG. 9. However, since the motion of the yarn guide 9 is a simple periodic motion, the shape of the fancy thicker portions is identical and these fancy thicker portions are distributed along the fancy textured yarn at an identical interval. To modify the above-mentioned conditions of the fancy thicker portions, additional mechanisms such as cam mechanisms which change the displacing speed of the reciprocal motion of the yarn guide 9 can be utilized.

Figure 10:
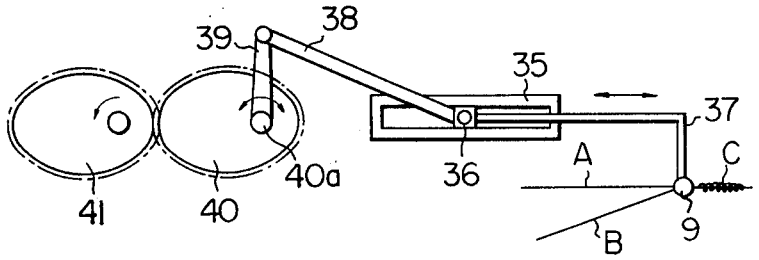
FIGS. 9, 10, 11 are schematic side views of the reciprocal motion mechanism of the yarn guide which can be utilized for the present invention.
Figure 9:
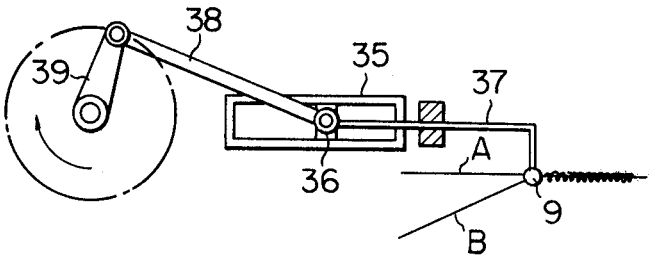

B. The mechanism shown in FIG. 10 is a modification of the mechanism shown in FIG. 9. Therefore, the elements having functions similar to the elements of the embodiment shown in FIG. 9 are represented by the identical reference numeral, respectively. The only difference in the mechanism shown in FIG. 10 from the mechanism shown in FIG. 9 is the drawing mechanism of the crank arm 39. That is, the shaft 40*a* of the crank arm 39 is rotated by an elliptical gear wheel 40 which meshes with a driving elliptical gear wheel 41. Consequently, the displacing speed of the yarn guide 9 is modified remarkably, so that a distinguished fancy effect of the textured fancy yarn according to the present invention can be expected.

Figure 11:
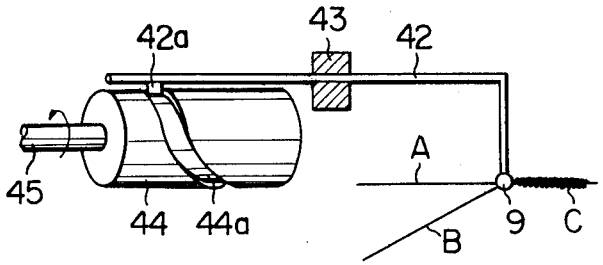

C. A cam mechanism as shown in FIG. 11 is also useful to provide the reciprocal motion of the yarn guide 9. That is, the yarn guide 9 is mounted on a guide rod 42 which is slidably supported by a sliding guide 43. A cylindrical cam 44 provided with a cam groove 44*a* is mounted on a shaft 45 which is rotating. A guide roll 42*a* turnably mounted on a free end portion of the guide rod 42 is engaged into the cam groove 44*a*. Consequently, any desirable reciprocal motion of the yarn guide 9 can be created by appropriately designing the shape of the cam groove 44*a*.

Figure 12A:
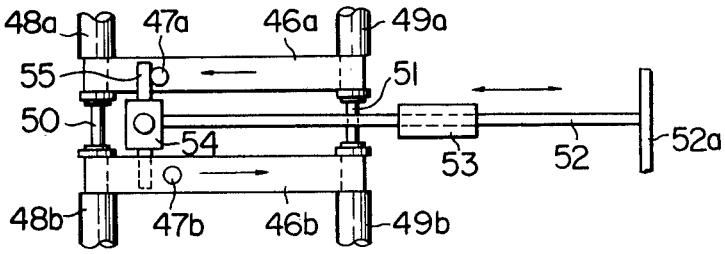
FIG. 12A and 12B are schematic plan and side views of another embodiment of the reciprocal motion mechanism of the yarn guide which can be utilized for the present invention.
Figure 12B:
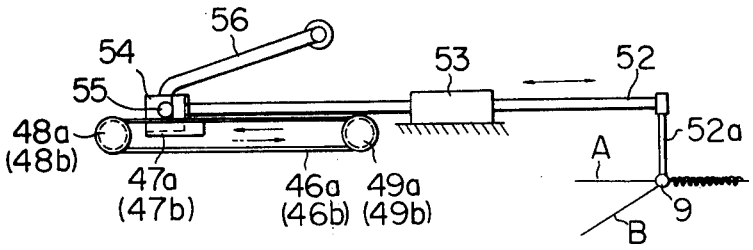

D. In the mechanism shown in FIG. 12A and 12B, a pair of endless belts 46*a* and 46*b* are provided with a projection 47*a*, 47*b* secured thereon, respectively. The endless belt 46*a* is rotatably supported by a pair of guide rollers 48*a* and 49*a*, while the endless belt 46*b* is rotatably supported by a pair of guide rollers 48*b* and 49*b*. The guide rollers 48*a* and 48*b* are turnably mounted on a common shaft 50, while the guide rollers 49*a* and 49*b* are turnably mounted on an another common shaft 51, and the guide rollers 48*a* and 48*b* are positively driven by respective driving mechanisms (not shown) in reverse directions from each other. Consequently, the endless belts 46*a* and 46*b* are driven in reverse directions from each other. The yarn guide 9 is mounted on a supporting bar 52*a* of a sliding rod 52 which is slidably supported by a sliding guide 53 in such a condition that the sliding passage of the sliding rod 52 is parallel to the arrangement of the endless belts 46*a* and 46*b*. A solenoid 54 is mounted on a free end of the sliding rod 52 and the solenoid 54 is provided with a plunger 55 which is capable of alternately projecting toward the displacing passage of the projections 47*a* and 47*b* of the endless belts 46*a* and 46*b* in such a condition that when the plunger 55 is projected toward the endless belt 46*a*, the plunger 55 engages with the projection 47*a* and, consequently, the solenoid 54 is forced to displace together with the displacement of the projection 47*a* until the plunger 55 disengages from the projection 47*a*. On the other hand, when the plunger 55 is projected toward the endless belt 46*b*, the plunger 55 engages with the projection 47*b* and, consequently, the solenoid 54 is displaced together with the projection 47*b* until the plunger 55 disengages from the projection 47*b*. The solenoid 54 is actuated by a control signal from a control box (not shown) via a conduit 56. According to the above-mentioned mechanism, various reciprocal motions of the yarn guide 9 can be created by programming the schedule for issuing the control signal for actuating the solenoid 55. Further, if the driving speeds of these endless belts 46*a* and 46*b* are changed, the displacing speed of the yarn guide 9 can be also modified in a desired condition.

What is claimed is:

1. Method for manufacturing a fancy textured yarn provided with numerous fancy slubs by means of a false twisting apparatus provided with a false twisting member and a heater disposed at a twisting zone upstream of said false twisting member, comprising supplying at least one multifilament yarn A and at least one multifilament yarn B into said twisting zone independently, combining said yarn B with said yarn A at a wrapping point reciprocally moving along the yarn passage of said yarn A in said twisting zone, displacing said wrapping point toward the running direction of said yarn A at a speed in a range between less than the running speed of said yarn A and approximately 0.5 times that of said running speed and heating the thus formed composite yarn in said twisting zone.

2. Method for manufacturing a fancy textured yarn according to claim 1, wherein said wrapping point is continuously reciprocating along said yarn passage of said yarn A.

3. Method for manufacturing a fancy textured yarn according to claim 1, wherein said wrapping point is intermittently reciprocating along said yarn passage of said yarn A.

4. Method for manufacturing a fancy textured yarn according to claim 1, wherein said wrapping point is defined by a yarn guide which guides said yarn B.

5. Method for manufacturing a fancy textured yarn according to claim 1, wherein said reciprocal displacement of said wrapping point is carried out at a place upstream of said heater.

6. Method for manufacturing a fancy textured yarn according to claim 1, further comprising controlling the tension of said yarn B so as to supply said yarn B into said twisting zone in a range between less than 0.5 and more than 0.1 times the running tension of said yarn A in said twisting zone.

7. Method for manufacturing a fancy textured yarn according to claim 1, further comprising controlling the tension of said yarn B so as to supply said yarn B into said twisting zone in a range between the running tension and more than 0.8 times said running tension of said yarn A.

8. Method for manufacturing a fancy textured yarn according to claim 1, further comprising controlling the running tension of said yarn A in said twisting zone by automatically absorbing excess variation of said running tension, said absorption of excess variation of said running tension being carried out by changing the length of a yarn passage formed at a position upstream of a portion of said twisting zone where said wrapping point moves, in balanced condition with a predetermined running tension of said yarn A.

9. Method for manufacturing a fancy textured yarn according to claim 8, further comprising controlling the tension of said yarn B so as to supply said yarn B into said twisting zone in a range between less than 0.5 and more than 0.1 times said running tension of said yarn A in said twisting zone.

10. Method for manufacturing a fancy textured yarn according to claim 8, further comprising controlling the tension of said yarn B so as to supply said yarn B into said twisting zone in a range between said running tension of said yarn A in said twisting zone and more than 0.8 times said running tension of said yarn A.

11. Method for manufacturing a fancy textured yarn according to claim 1, wherein said yarn A is a thermoplastic synthetic yarn.

12. Method for manufacturing a fancy textured yarn according to claim 1, wherein said yarn A is provided with a different dyeability from said yarn B.

* * * * *